US009541046B2

(12) United States Patent
Yasukawa et al.

(10) Patent No.: US 9,541,046 B2
(45) Date of Patent: Jan. 10, 2017

(54) FUEL INJECTION DEVICE

(71) Applicant: Hitachi Automotive Systems, Ltd., Hitachinaka-shi, Ibaraki (JP)

(72) Inventors: Yoshihito Yasukawa, Hitachinaka (JP); Hideharu Ehara, Hitachinaka (JP); Tohru Ishikawa, Hitachinaka (JP); Motoyuki Abe, Tokyo (JP); Ryo Kusakabe, Tokyo (JP)

(73) Assignee: Hitachi Automotive Systems, Ltd., Hitachinaka-shi (JP)

( * ) Notice: Subject to any disclaimer, the term of this patent is extended or adjusted under 35 U.S.C. 154(b) by 0 days.

(21) Appl. No.: 14/763,029

(22) PCT Filed: Jan. 10, 2014

(86) PCT No.: PCT/JP2014/050272
§ 371 (c)(1),
(2) Date: Jul. 23, 2015

(87) PCT Pub. No.: WO2014/115587
PCT Pub. Date: Jul. 31, 2014

(65) Prior Publication Data

US 2015/0354515 A1 Dec. 10, 2015

(30) Foreign Application Priority Data

Jan. 24, 2013 (JP) ..... 2013-010731

(51) Int. Cl.
*B05B 1/30* (2006.01)
*F02M 51/06* (2006.01)
(Continued)

(52) U.S. Cl.
CPC ..... *F02M 51/061* (2013.01); *F02M 45/00* (2013.01); *F02M 45/08* (2013.01); *F02M 51/066* (2013.01);
(Continued)

(58) Field of Classification Search
CPC ..... F02M 51/0625; F02M 51/0621; F02M 51/066; F02M 51/0671; F02M 61/166; F02M 43/04; F02M 45/86; F02M 47/027
(Continued)

(56) References Cited

U.S. PATENT DOCUMENTS 5,709,342 A * 1/1998 McCauley ..... F02M 57/025 137/625.65
6,279,843 B1 * 8/2001 Coldren ..... F02M 47/027 239/585.1
(Continued)

FOREIGN PATENT DOCUMENTS

JP 11-44275 2/1999
JP 2000-46224 2/2000
(Continued)

OTHER PUBLICATIONS

International Search Report (PCT/ISA/210) dated Feb. 18, 2014 with English translation (five pages).
(Continued)

*Primary Examiner* — Davis Hwu
(74) *Attorney, Agent, or Firm* — Crowell & Moring LLP

(57) ABSTRACT

A fuel injection valve having a variable stroke mechanism is constructed. A valve body provided to be slidable; a first movable element for cooperating with the valve body; an inner fixed iron core provided at a position to oppose a second movable element; an outer fixed iron core; and a coil are included. A lift amount of the second movable element is set larger than a lift amount of the first movable element, and a portion of the second movable element is projected into the first movable element. In this way, large and small lifts are constituted by using a difference between magnetic attractive forces that are generated in the first movable
(Continued)

element and the second movable element by a current supplied to the coil.

20 Claims, 7 Drawing Sheets

(51) Int. Cl.
*F02M 61/04* (2006.01)
*F02M 45/00* (2006.01)
*F02M 45/08* (2006.01)
*F02D 41/20* (2006.01)

(52) U.S. Cl.
CPC ..... *F02M 51/0625* (2013.01); *F02M 51/0657* (2013.01); *F02M 61/04* (2013.01); *F02D 41/20* (2013.01); *F02M 2200/08* (2013.01)

(58) Field of Classification Search
USPC ..... 239/585.1, 585.3–585.5
See application file for complete search history.

(56) References Cited

U.S. PATENT DOCUMENTS 6,510,841 B1 1/2003 Stier
2003/0178509 A1 9/2003 Porter
2006/0124775 A1* 6/2006 Harcombe ..... F02M 63/0015 239/585.1
2008/0116405 A1* 5/2008 Bolbolan ..... B21K 25/00 251/129.01
2010/0186719 A1* 7/2010 Venkataraghavan F02M 47/027 123/472

FOREIGN PATENT DOCUMENTS

JP 2003-511604 A 3/2003
JP 2003-269289 A 9/2003
JP 2004-225659 A 8/2004
JP 2005-307751 A 11/2005
JP 2010-53812 A 3/2010
JP 2011-208603 A 10/2011
JP 2013-167194 A 8/2013
JP 2013-227880 A 11/2013

OTHER PUBLICATIONS

Japanese Office Action dated May 10, 2016 with English-language translation (12 pages).

* cited by examiner

FUEL INJECTION DEVICE

TECHNICAL FIELD

The present invention relates to a fuel injection valve for supplying fuel to an internal combustion engine, and in particular to a fuel injection valve that realizes balance between low fuel consumption and high output.

BACKGROUND ART

In recent years, regulations related to automotive fuel consumption have become strict, and low fuel consumption has been desired for automotive internal combustion engines. Meanwhile, high output has also been desired for the internal combustion engines. In order to achieve the low fuel consumption and the high output simultaneously, an injection amount control range needs to be expanded so as to conform to a wide operation region of the engine. In order to do so, it is desired that a lift amount (a stroke) of a valve body that determines a cross sectional area of a flow passage in a fuel injection section is variable.

As a fuel injection valve for realizing this, a configuration having two movable elements is disclosed in PTL1.

CITATION LIST

Patent Literature

PTL1: JP-A-2004-225659

SUMMARY OF INVENTION

Technical Problem

However, in PTL1, objects moved by the moving elements differ, and the stroke is not generated in two stages.

An object of the invention is to provide a fuel injection valve that allows a stroke amount of a valve body to be variable in order to expand a control range of a fuel injection amount that is required for a wide operating state of an engine, such as balance between low fuel consumption and high output.

Solution to Problem

In order to solve the problem, the invention adopts a configuration as follows.

In a fuel injection valve that includes: a valve body provided to be slidable; a movable element for cooperating with the valve body; a fixed iron core provided at a position to oppose the movable element; a valve seat member formed with an annular valve seat; and a coil for displacing the movable element and causing the valve body to be seated on or unseated from the valve seat, a plurality of the movable elements is engaged with the one valve body.

Advantageous Effects of Invention

According to the fuel injection valve of the invention, the control range of the fuel injection amount is expanded by constituting the plural strokes, and thus optimum fuel injection can be realized in the wide operation region of the engine.

DESCRIPTION OF EMBODIMENTS

Example 1

Figure 1:
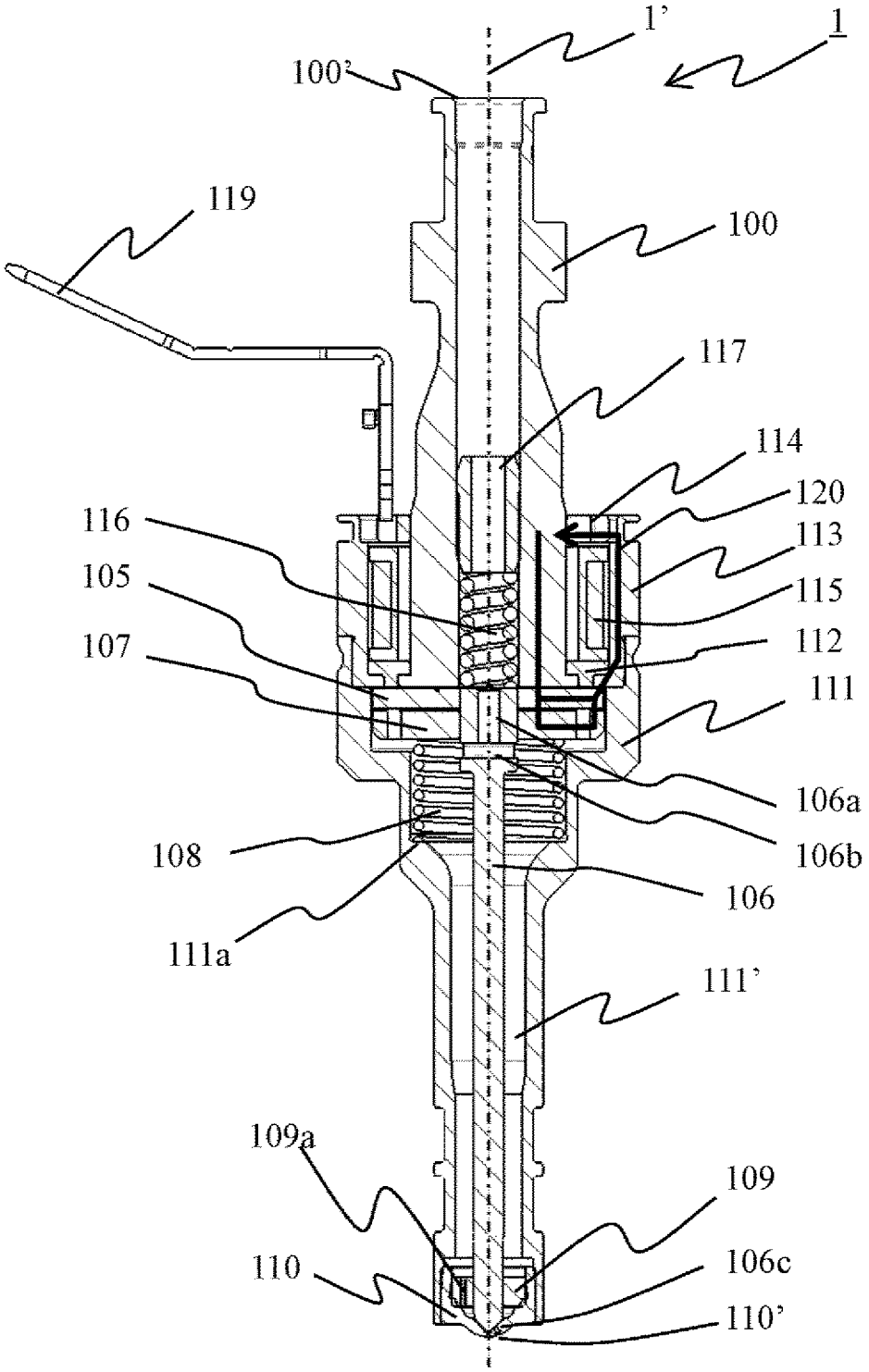
FIG. 1 is a cross-sectional view of a structure of a fuel injection valve according to an embodiment of the invention.
Figure 2A:
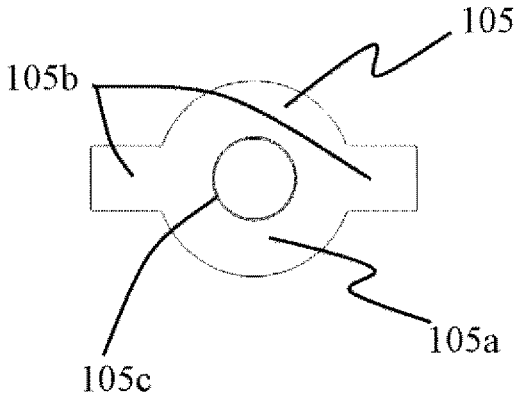
FIG. 2A is a view of a second movable element according to the embodiment of the invention that is seen from above the fuel injection valve.
Figure 2B:
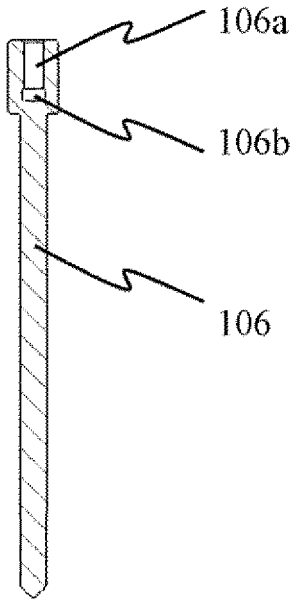
FIG. 2B is a cross-sectional view in an orthogonal direction of a valve body in FIG. 1 according to the embodiment of the invention.
Figure 2C:
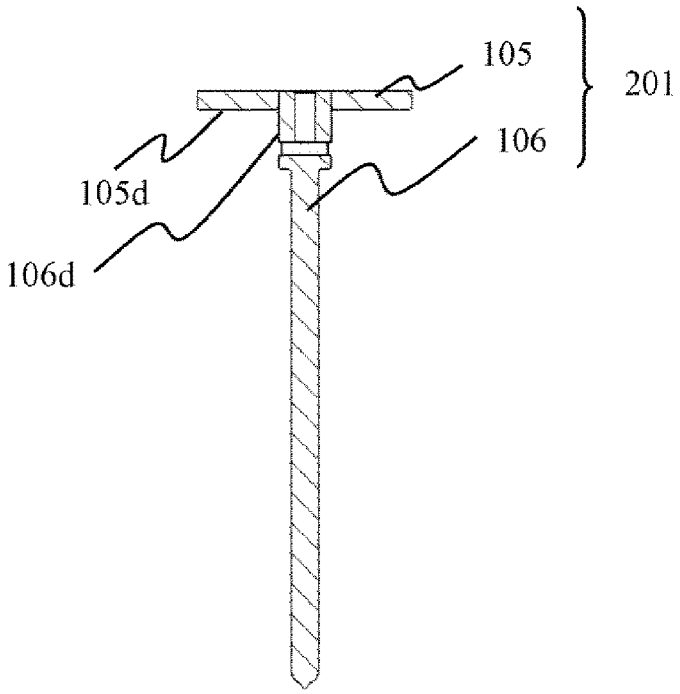
FIG. 2C is a cross-sectional view of a movable body in which the second movable element and the valve body are combined according to the embodiment of the invention.
Figure 3A:
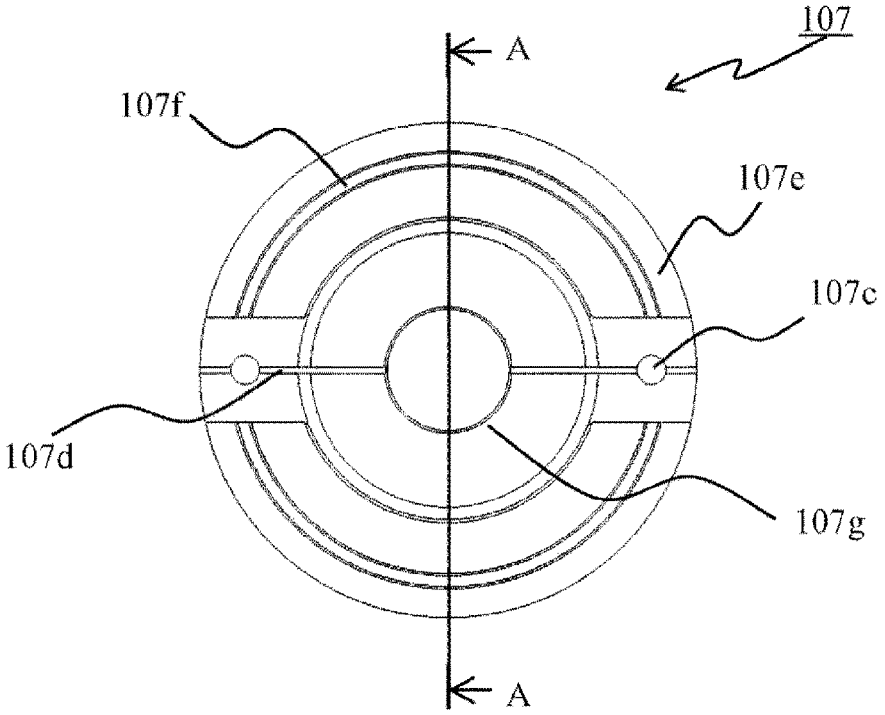
FIG. 3A is a top view of a first movable element according to the embodiment of the invention that is seen from above the fuel injection valve.
Figure 3B:
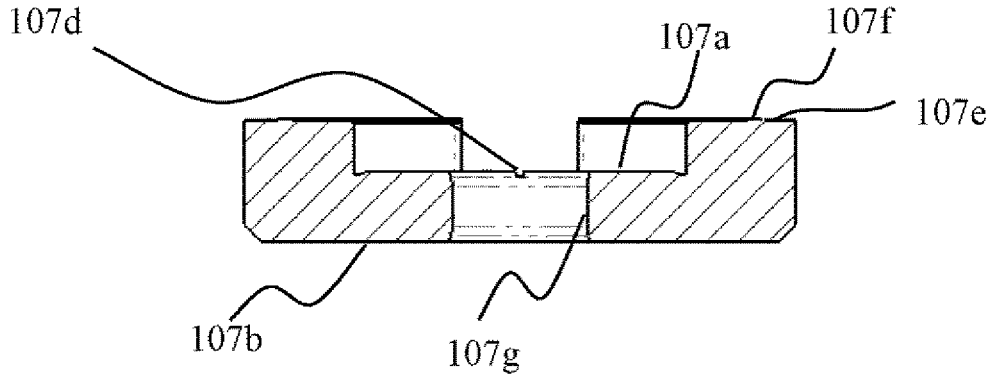
FIG. 3B is an enlarged cross-sectional view that is taken along A-A in FIG. 3*a*.
Figure 4:
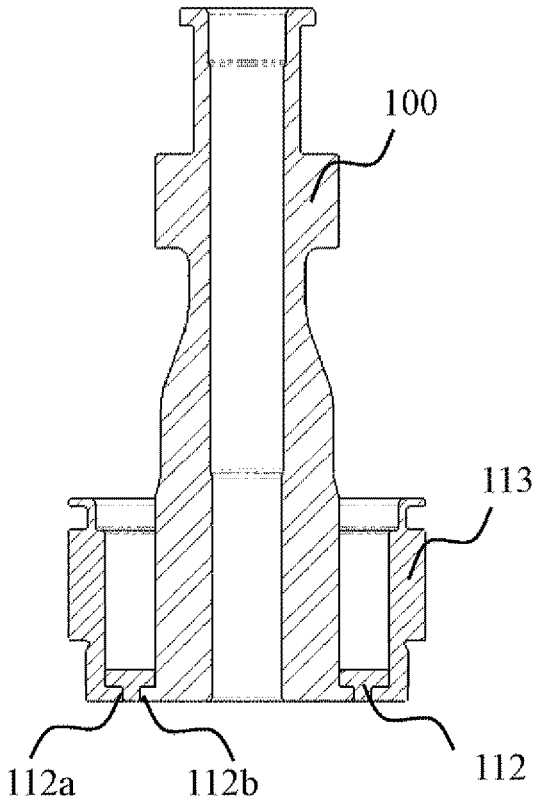
FIG. 4 is an enlarged cross-sectional view of a fixed iron core section according to the embodiment of the invention.
Figure 5:
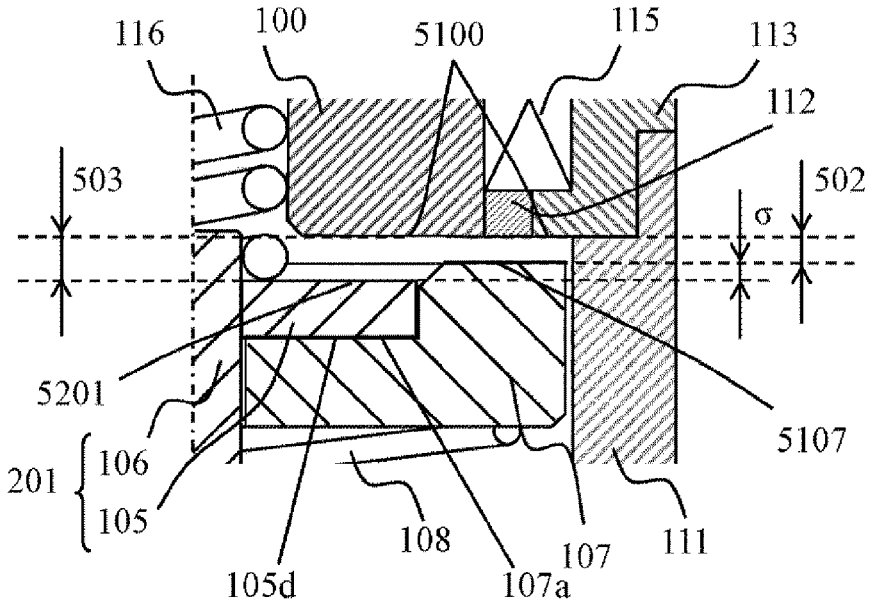
FIG. 5 is an enlarged view of a movable section according to the embodiment of the invention.
Figure 6A:
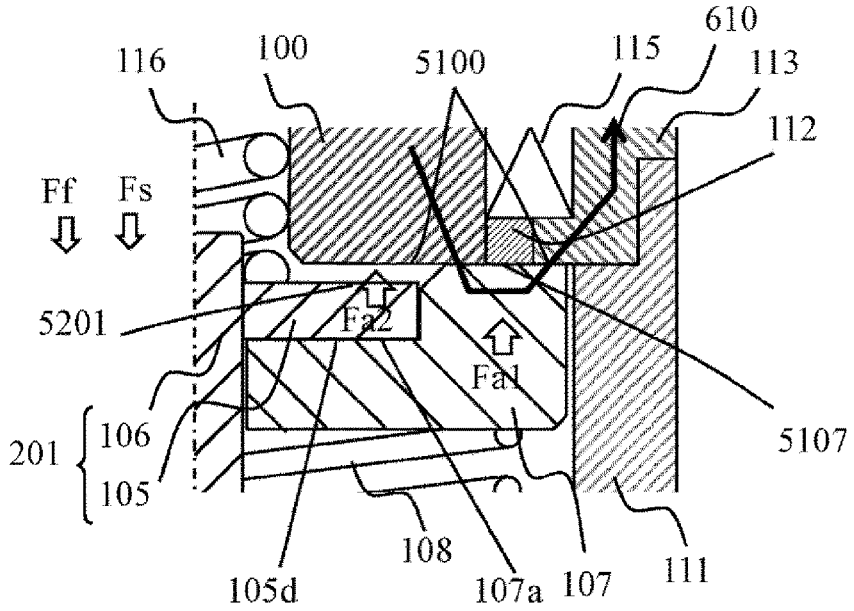
FIG. 6A is an enlarged view of the movable section when a small stroke is generated according to the embodiment of the invention.
Figure 6B:
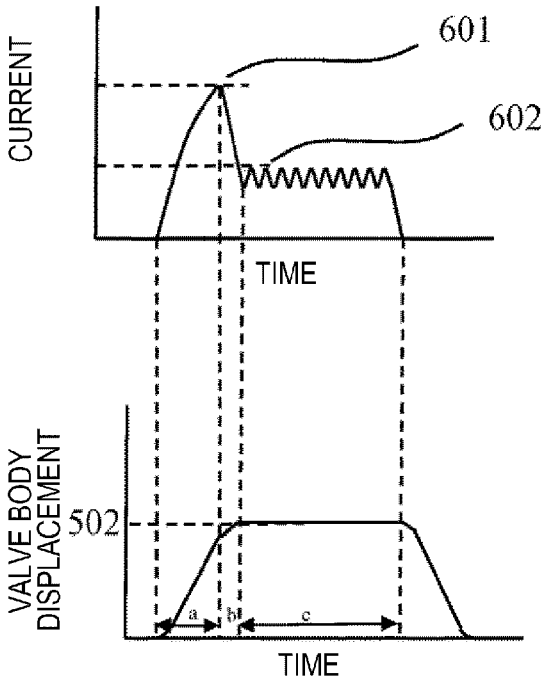
FIG. 6B is a graph of displacement of a drive current waveform and the valve body when the small stroke is generated according to the embodiment of the invention.
Figure 7A:
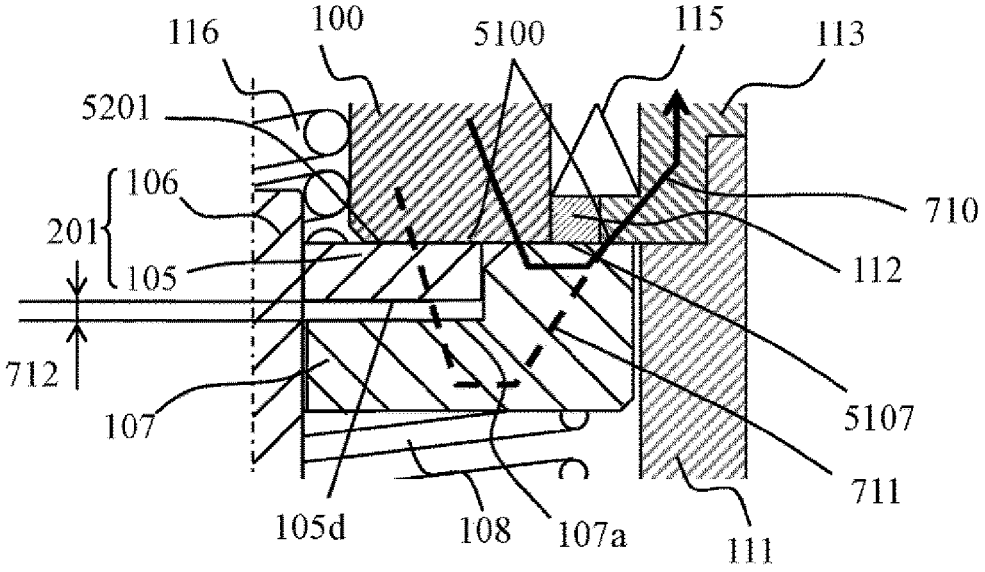
FIG. 7A is an enlarged view of the movable section with the small stroke according to the embodiment of the invention.
Figure 7B:
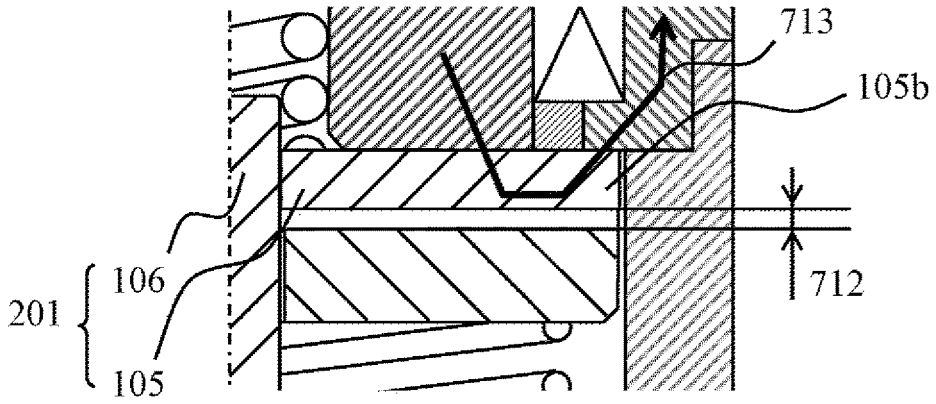
FIG. 7B is an enlarged view of the movable section when a large stroke is generated according to the embodiment of the invention.
Figure 7C:
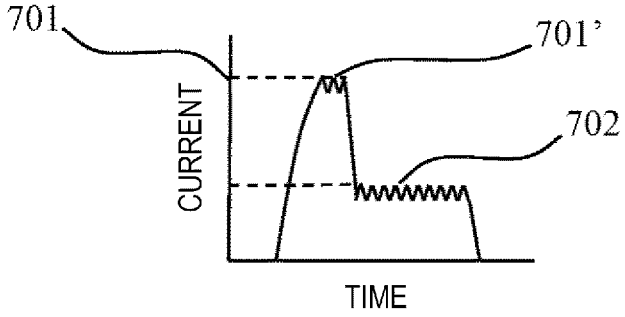
FIG. 7C is the drive current waveform when the large stroke is generated according to the embodiment of the invention.

A description will hereinafter be made on a fuel injection valve according to a first embodiment of the invention with reference to FIG. 1 to FIG. 7. FIG. 1 is a cross-sectional view of a structure of the fuel injection valve according to the embodiment of the invention. FIGS. 2 to 3 are explanatory views of a movable element according to the embodiment of the invention. FIG. 4 is an enlarged cross-sectional view of a fixed iron core section according to the embodiment of the invention. FIG. 5 is an enlarged view of a movable section according to the embodiment of the invention. FIG. 6 is an enlarged view of the movable section and a drive current waveform when a small stroke is generated according to the embodiment of the invention. FIG. 7 is an enlarged view of the movable section and the drive current waveform when a large stroke is generated according to the embodiment of the invention.

First, a description will be made on an overall configuration and a flow of fuel in a fuel injection valve 1.

The fuel injection valve 1 is configured by including: an injection hole constituting member 110 that has a fuel injection hole 110' for injecting the fuel; a nozzle body 111 that contains a valve body 106 driven vertically; and an inner fixed iron core 100, a first movable element 107, a second movable element 105, an outer fixed iron core 113, an upper fixed iron core 114 that constitute a magnetic circuit 120 in the case where a valve opening signal is provided to a coil 115 through a terminal 119. Furthermore, the fuel injection valve 1 is configured by including: an upper spring 116, an upper side of which is supported by a spring retaining pin 117, and that generates a force on a lower side, the spring retaining pin 117 causing a force to be acted on the valve body 106 at a time of non-energization; and a lower spring 108 that is supported by a receiving section 111*a* of the nozzle body 111 and applies an upward force via the first movable element 107.

The fuel that flows in from a fuel inflow section 100' connected to an undepicted fuel pipe flows along a center axis 1' of the fuel injection valve, flows through a fuel passage 106*a* that is positioned at the upper center of the valve body 106 and a transverse fuel passage 106*b* that communicates in a radial direction, flows through a space 111' between the nozzle body 111 and the valve body 106, flows through a fuel passage section 109*a* of a guide member 109 that is positioned at a tip of the fuel injection valve 1, reaches a seat section 106*c* on which the valve body 106 and the injection hole constituting member 110 are seated, and, at a time of energization, flows through a gap produced in the seat section 106*c*. In this way, the fuel is injected from the fuel injection hole 110'.

Next, a description will be made on configurations of the first movable element 107, the second movable element 105, and the valve body that function as a movable section.

FIG. 2(*a*) is a top view of the second movable element 105 that is seen from above the fuel injection valve. FIG. 2(*b*) is a cross-sectional view in an orthogonal direction of the valve body 106 in FIG. 1. FIG. 2(*c*) is a cross-sectional view of a movable body 201 in which the second movable element 105 and the valve body 106 are combined. FIG. 3(*a*) is a top view of the first movable element 107 that is seen from above the fuel injection valve. FIG. 3(*b*) is a cross-sectional view that is taken along A-A in FIG. 3(*a*).

It is characterized that the second movable element 105 in the invention has a circular section 105*a* that serves as a magnetic attraction surface and an outer periphery extending section 105*b* that extends from the circular section to an outer periphery. In addition, an inner diameter hole 105*c* that is used to be integrated with an outer diameter section of the valve body 106 by press fitting or the like is perforated. In this way, the second movable element 105 and the valve body 106 operate as the integrated movable body 201.

The first movable element 107 has an upper surface 107*e* that is paired with each of the fixed iron cores on an inner peripheral side and an outer peripheral side, and a projected section 107*f* is provided in a portion thereof. The projected section 107*f* suppresses a sticking force by the fuel that exists between the fixed iron core and the upper surface 107*e* of the first movable element. In addition, the first movable element 107 has an intermediate surface 107*a* that comes in contact with and is fitted with a lower surface 105*d* of the second movable element in the movable body 201. The intermediate surface 107*a* has: an axial fuel passage 107*c* that serves as a fuel passage at a time of contact with the movable body 201; and a radial fuel passage 107*d*, and suppresses generation of the sticking force by the fuel. A lower surface 107*b* of the first movable element comes in contact with the lower spring 108 and generates an upward force. Furthermore, a hole 107*g* is perforated at the center of the first movable element 107 and penetrated by an outer peripheral section 106*d* of the valve body 106 in the movable body 201.

Next, a description will be made on the fixed iron cores for attracting the first and second movable elements. It is characterized that a spacer 112 is provided between the inner fixed iron core 100 and the outer fixed iron core 113 in the fuel injection valve of the invention. There is a case where the spacer 112 is joined to the inner fixed iron core 100 and the outer fixed iron core 113 by welding, or there is a case where the spacer 112 is coupled thereto by tension joining of metals in crushed sections 112*a, b* that is caused by a load from an upper direction. While the inner fixed iron core 100 and the outer fixed iron core 113 are magnetic materials, the spacer 112 is a non-magnetic material. If the spacer 112 is the magnetic material, the magnetic circuit 120 as in FIG. 1 is configured by including the inner fixed iron core 100, the spacer 112, the outer fixed iron core 113, and the upper fixed iron core 114, and thus the magnetic attractive force is not generated in the first movable element 107 and the second movable element 105.

Hereinafter, a description will be made on an operation principle for achieving two types of stroke, which is the characteristic of the invention. It is characterized that this operation constitutes large and small lifts by using a difference between the magnetic attractive forces generated in the first movable element 107 and the second movable element 105, the difference being generated by a current supplied to the coil.

FIG. 5 is a view of a valve closed state of the movable section according to the embodiment of the invention. FIG. 6(*a*) is an enlarged view of the movable section at a time of a small stroke according to the embodiment of the invention, and FIG. 6(*b*) is a graph of displacement of a drive current waveform and the valve body when the small stroke is generated. FIG. 7(*a*) (*b*) are each an enlarged view of the movable section at a time of a large stroke according to the embodiment of the invention, and FIG. 7(*c*) is the drive current waveform when the large stroke is generated. Then, a peak value 701 in FIG. 7 is set higher than a peak value 601 in FIG. 6(*b*), and a retaining current value 702 is set higher than a retaining current value 602 in FIG. 6(*b*). In the above drawings, components denoted by the same signs as those in FIG. 1 are the same as the components in FIG. 1. Thus, a detailed description thereon will not be made, and the components are referred to in this description on the operation as necessary.

First, a description will be made on a configuration in the valve closed state by using FIG. 5. In a state that the fuel injection valve according to the invention is closed, a gap 502 is constructed between a lower end surface 5100 of the inner fixed iron core 100 and the outer fixed iron core 113 and an upper end surface 5107 of the first movable element 107, and a gap 503 is constructed between the lower end surface 5100 of the inner fixed iron core 100 and the outer fixed iron core 113 and an upper end surface 5201 of the second movable element 105. The gaps 502, 503 correspond to lift amounts of the fuel injection valve. The gap 503 is constructed to be larger than the gap 502, and thus two types of the lift in the fuel injection valve in the invention are constituted. In this example, in a state that the first movable element 107 and the second movable element 105 contact each other, a difference σ between the two lift amounts is constituted by a difference in height between the upper end surfaces 5107 and 5201. However, the difference can be adjusted by using the spacer or the like.

Next, a description will hereinafter be made on a configuration in which a small lift amount of the two lift amounts is achieved. In the fuel injection valve according to the invention, when the current is supplied to the coil 115, the first movable element 107 is attracted upward, the lower end surface 5100 of the inner fixed iron core 100 and the outer fixed iron core 113 comes in contact with the upper end surface 5107 of the first movable element, and the small stroke is constituted. If restated by a relationship of the action of the force, it will be as described as below.

As depicted in FIG. 6(*a*), forces for pressing the movable body 201, which is formed of the second movable element 105 and the valve body 106, downward are fuel pressure=Ff and a differential force between the upper spring 116 and the lower spring 108=Fs. On the contrary, forces for pressing the movable body 201, which is formed of the second movable element 105 and the valve body 106, upward are a magnetic force that acts on the first movable element 107=Fa1 and a magnetic force that acts on the second movable element 105=Fa2. When Ff+Fs<Fa1 and Ff+Fs>Fa2, the valve body 106 generates the small stroke. At this time, the second movable element 105 does not contact the lower end surface 5100 of the inner fixed iron core 100 and the outer fixed iron core 113, and the intermediate surface 107*a* of the first movable element and the lower surface 105*d* of the second movable element are in a contact state. Then, magnetic flux generated by the energization to the coil 115 passes, and a main magnetic circuit 610 is thus constituted.

As depicted in FIG. 6(*b*), a force that acts downward by a difference between the upper spring 116 and the lower spring 108 and that acts on the first movable element is generated by the peak value 601 and the lower retaining current value 602 than the peak value 601 of the drive current waveform for energizing the coil 115, and the magnetic attractive force that is larger than the force acting downward is generated by the fuel are generated. In this way, only the first movable element 107 is driven. At this time, the magnetic attractive force generated in the second movable element 105 is smaller than the force acting downward by the difference between the upper spring 116 and the lower spring 108 and the force acting downward by the fuel. Thus, as in the above description, the intermediate surface 107*a* of the first movable element and the lower surface 105*d* of the second movable element remain in the contact state.

A description will be made on displacement of the valve body 106 by using FIG. 6 (*b*). When being applied with the drive current waveform at the peak value 601, which energizes the coil 115, the valve body 106 is abruptly elevated in an a interval. Then, the drive current is lowered from the peak value, an elevation speed of the valve body 106 is lowered in a b interval, and a retention current 602 is applied to the coil. In this way, as in a c interval, the valve body 106 is retained in the valve opening state.

Next, a description will hereinafter be made on a configuration in which a large lift amount of the two lift amounts is achieved by using FIG. 7(*a*) to (*c*). In the fuel injection valve according to the invention, when the current is supplied to the coil 115, the second movable element 105 is attracted at the same time that the first movable element 107 is attracted upward, the lower end surface 5100 of the inner fixed iron core 100 and the outer fixed iron core 113 comes in contact with the upper end surface 5107 of the first movable element and the upper end surface 5201 of the second movable element, so as to constitute the large stroke. At this time, the magnetic flux that is generated by the energization to the coil 115 passes, and main magnetic circuits 710, 711 are thus constituted.

As depicted in FIG. 7(*c*), after the peak value 701 of the waveform of the drive current for energizing the coil 115 is reached, a current value 701' at which the peak current is retained is generated, and the retaining current value 702 is generated thereafter. In this way, the magnetic attractive force is generated to exceed the force that acts downward by the difference between the upper spring 116 and the lower spring 108 and acts on the second movable element and the force that acts downward by the fuel, and the second movable element is driven together with the first movable element 107. If restated by the relationship of the action of the force, it will be as described as below.

As depicted in FIG. 6, forces for pressing the valve body 106 downward are the fuel pressure=Ff and the differential force between the upper spring 116 and the lower spring 108=Fs. On the contrary, forces for pressing the valve body 106 upward are the magnetic force acting on the first movable element 107=Fa1 and the magnetic force acting on the second movable element 105=Fa2. When Ff+Fs<Fa1 and Ff+Fs<Fa2, the valve body 106 generates the large stroke.

At this time, as described above in FIG. 2, the reason why the second movable element 105 has a shape to extend to the outer peripheral side by having the outer periphery extending section 105*b* that extends from the circular section to the outer periphery is as follows.

At the time of the large lift, a gap 712 is constructed between the first movable element 107 and the second movable element 105. When the fuel injection valve has the cross section in FIG. 7(*a*) for an entire periphery in a circumferential direction, the magnetic flux that enters the second movable element 105 from the inner fixed iron core 100 is less likely to pass through the outer fixed iron core 113. Thus, the magnetic attractive force required for the second movable element 105 is less likely to be obtained. However, a portion in the circumferential direction has the cross section as depicted in FIG. 7(*b*) since the second movable element 105 has the shape to extend to the outer peripheral side by having the outer periphery extending section 105*b* that extends from the circular section to the outer periphery. In this case, the magnetic flux that enters the second movable element 105 from the inner fixed iron core 100 passes through the outer fixed iron core 113, and thus, the magnetic attractive force required for the second movable element 105 is obtained. As the portion that is extended to the outer peripheral side of the second movable element 105 is increased, an area of the magnetic attraction surface of the first movable element 107 is decreased. Thus, the shape thereof is optimally determined by a required magnitude of the attractive force and a use condition. In addition, also in the case where the same magnitude of the attractive force is generated, a design for decreasing an overall weight of the movable body 201 is desired from a perspective of suppressing a bound with the valve seat section of the valve body that is generated when the fuel injection valve is closed.

In the method for adjusting the lift amounts according to the invention, either one of the large lift amount and the small lift amount is determined in advance. Then, the other of the lift amounts is determined from a difference in height between the first movable element 107 and the second movable element 105. Desirably, it is preferred that the large lift amount is determined after the small lift amount is determined in advance. The reason for this is because a rate of fluctuations in the injection amount of the fuel injection valve, which corresponds to an adjustment error of the lift, is increased when the lift amount is small.

A description will hereinafter be made on a case where the two types of the lift is switched in the fuel injection valve for generating the two types of the lift when the fuel injection valve is installed in an undepicted internal combustion engine. The case where a small injection amount is required by decreasing the lift amount mainly occurs when a rotational speed of the internal combustion engine is low, when generated torque of the internal combustion engine is low, and when fuel injection pressure is low. In other words, in the case where a certain threshold is past on the basis of information of each of an airflow sensor for sensing an intake air amount, a crank sensor for sensing the rotational speed, and a pressure sensor for sensing fuel injection pressure, the waveform is switched to that for the small stroke. In addition, in the case where an accelerator opening degree is suddenly decreased in an operation state that the accelerator opening degree is high, the rotational speed is high, and the torque is also high, it is desired to switch the waveform to that for generating the small stroke even with the high fuel pressure.

In this example, the intake air amount, the rotational speed of the internal combustion engine, the fuel injection pressure, the accelerator opening degree are sensed, and the waveform of the current that is supplied to the fuel injection valve is switched by the threshold. However, when the similar effect can be obtained by using another information, switching is possible.

In this example, the structure in which the second movable element 105 and the valve body 106 are originally the separate members but are integrated by press fitting or the like is adopted. However, even with an originally integrated structure, a configuration thereof will not be limited as long as the second movable element 105 and the valve body 106 are attracted to the inner fixed iron core 100 and the outer fixed iron core 113, and the fuel can be sealed in the valve seat section 106*c*.

In this example, the description is made on the current waveform that does not retain the peak current at the time of the small stroke and the waveform that retains the peak current at the time of the large stroke. However, the operational effects according to the invention are not impaired with another current waveform as long as it is a current waveform that allows the movable element to constitute the two types of the stroke.

In this example, the spacer 112 as the non-magnetic member is constructed as a single part. However, even when this is constructed of plural members, the operational effects according to the invention are not impaired.

REFERENCE SIGNS LIST

1 Fuel injection valve
100 Inner fixed iron core
105 Second movable element
106 Valve body
107 First movable element
108 Lower spring
110 Injection hole component
111 Nozzle body
112 Spacer
113 Outer fixed iron core
116 Upper spring

The invention claimed is:

1. A fuel injection valve comprising:
a valve body;
a movable element for moving the valve body;
a fixed iron core provided at a position to oppose the movable element;
a valve seat member formed with a valve seat; and
a coil for displacing the movable element and causing the valve body to be seated on or unseated from the valve seat, wherein
the movable element moves the vale body and is constructed of a first movable element and a second movable element, the valve body is a two stroke valve body that is configured to be moved by movement of the first movable element, and the two stroke valve body is configured to be moved by movement of the second movable element independent of any movement of the first movable element.

2. The fuel injection valve according to claim 1 wherein a first current is applied to the first movable element, and a second current is applied to the second movable element, the second current having a greater magnitude than the first current such that movement of the valve body by the second movable element results in a larger stroke than a stroke caused by movement of the valve body by the first movable element.

3. The fuel injection valve according to claim 1 wherein the second movable element is arranged on the valve body side from the first movable element, and a portion of the second movable element is projected into the first movable element.

4. The fuel injection valve according to claim 1 wherein a surface of the fixed iron core that corresponds to the two movable elements is divided into an inner peripheral side and an outer peripheral side in a radial direction.

5. The fuel injection valve according to claim 1 wherein a waveform of a drive current that is supplied to the fuel injection valve when the two movable elements are moved varies in accordance with a moving amount.

6. The fuel injection valve according to claim 1 wherein the first movable element and the second movable element are configured to contact the fixed iron core when being moved.

7. The fuel injection valve according to claim 1 wherein the second movable element is configured to be integrated with the valve body.

8. The fuel injection valve according to claim 1 wherein the first movable element causes the valve body to be moved by contacting the second movable element when being moved.

9. A fuel injection valve comprising:
a two stroke valve body;
a movable element having multiple movable elements that move the valve body;
a fixed iron core provided at a position to oppose the movable element;
a valve seat member formed with a valve seat; and
a coil for displacing the movable element and causing the valve body to be seated on or unseated from the valve seat, wherein
the movable element is constructed of a first movable element and a second movable element, and
the first movable element and the second movable element are movable independently.

10. The fuel injection valve according to claim 9, wherein different currents are applied to each of the multiple movable elements, the different currents causing the multiple movable elements to move by different amounts, such that the different amounts of movement of the multiple movable elements lead to different stroke amounts of fuel by the fuel injection valve.

11. The fuel injection valve according to claim 9 wherein the second movable element is arranged on the valve body side from the first movable element, and a portion of the second movable element is projected into the first movable element.

12. The fuel injection valve according to claim 1 wherein the first movable element and the second movable element are configured to contact the fixed iron core when being lifted.

13. The fuel injection valve according to claim 1 wherein the second movable element is configured to be integrated with the valve body.

14. The fuel injection valve according to claim 1 wherein the first movable element causes the valve body to be lifted by contacting the second movable element when being lifted.

15. A fuel injection valve comprising:

a valve body;

a movable element for moving the valve body;

a fixed iron core provided at a position to oppose the movable element;

a valve seat member formed with a valve seat; and a coil for displacing the movable element and causing the valve body to be seated on or unseated from the valve seat, wherein the movable element is configured to move the valve body for a first length by a flow of a first current through the coil and move the valve body for a second length that is longer than the first length by a flow of a second current that is larger than the first current through the coil.

16. The fuel injection valve according to claim 7, wherein the valve body is configured to be lifted by lifting of the first movable element, and the valve body is configured to be lifted by lifting of the second movable element.

17. The fuel injection valve according to claim 15 wherein a lift amount of the second movable element is larger than a lift amount of the first movable element.

18. The fuel injection valve according to claim 15 wherein the second movable element is arranged on the valve body side from the first movable element, and a portion of the second movable element is projected into the first movable element.

19. The fuel injection valve according to claim 15 wherein a surface of the fixed iron core that corresponds to the two movable elements is divided into an inner peripheral side and an outer peripheral side in a radial direction.

20. The fuel injection valve according to claim 15 wherein a waveform of a drive current that is supplied to the fuel injection valve when the two movable elements are lifted varies in accordance with the lift amount.

* * * * *